United States Patent [19]

Müntjes

[11] 4,442,687

[45] Apr. 17, 1984

[54] APPARATUS FOR THE TENTERING OF SKINS OR HIDES IN THE MANUFACTURE OF LEATHER

[75] Inventor: Wolfgang Müntjes, Mulheim an der Ruhr, Fed. Rep. of Germany

[73] Assignee: Ludw. Lindgens KG Lederfabrik, Mülheim an der Ruhr, Fed. Rep. of Germany

[21] Appl. No.: 183,693

[22] Filed: Sep. 3, 1980

[30] Foreign Application Priority Data

Sep. 7, 1979 [DE] Fed. Rep. of Germany ..... 2936118

[51] Int. Cl.[3] ..... C14B 1/58

[52] U.S. Cl. ..... 69/1; 69/19.1

[58] Field of Search ..... 69/1, 8, 19, 19.1, 19.3; 26/79, 94; 198/694, 696

[56] References Cited

U.S. PATENT DOCUMENTS

| | | | |
|---|---|---|---|
| 2,339,470 | 1/1944 | Fitzgeral | 69/19.3 |
| 2,350,961 | 6/1944 | Haskins | 26/79 X |
| 2,769,529 | 11/1956 | Soriano et al. | 198/696 X |
| 3,024,639 | 3/1962 | Lewis | 69/1 X |
| 3,563,066 | 2/1971 | Bajak et al. | 69/1 |
| 3,850,013 | 11/1974 | Polvara | 69/1 |
| 3,881,229 | 5/1975 | Reid | 198/696 X |

FOREIGN PATENT DOCUMENTS

| | | | |
|---|---|---|---|
| 25144 | 3/1981 | European Pat. Off. | 69/19.3 |
| 2838018 | 3/1979 | Fed. Rep. of Germany . | |
| 55682 | 5/1979 | Finland . | |
| 57617 | 5/1980 | Finland . | |
| 2187913 | 1/1974 | France . | |
| 2401997 | 9/1977 | France . | |
| 8000328 | 1/1980 | Netherlands . | |
| 1403961 | 8/1975 | United Kingdom . | |
| 595383 | 4/1978 | U.S.S.R. . | |
| 648610 | 2/1979 | U.S.S.R. . | |

*Primary Examiner*—Louis Rimrodt
*Attorney, Agent, or Firm*—Martin A. Farber

[57] ABSTRACT

In this tentering device the skin to be tentered is placed on a tentering frame in which a plurality of tentering clamps are displaceably held on radial guides, the skin being grasped by said tentering clamps is stretched by means of transmitted pulling forces.

For the dependable detection and holding of the outer edge of the skin to be tentered without slipping or displacement, each tentering clamp (7, 8, 28) is provided with a pressing device (20, 29) which is displaceable with it, particularly in the form of a roller (25, 30), cylinder or rotating brush which, in combination with a backer-up, arranged below the skin, smooths and positions the skin for the closing of the tentering clamps.

23 Claims, 5 Drawing Figures

APPARATUS FOR THE TENTERING OF SKINS OR HIDES IN THE MANUFACTURE OF LEATHER

The invention relates to an apparatus for the tentering of skins or hides in the manufacture of leather having a tentering frame in which a plurality of tentering clamps are held in displaceable manner on substantially radial guides.

Such an automatic tentering unit for the tentering of skins or hides before drying is already known. In this case the skin to be tentered is placed on the tentering frame and grasped by tentering clamps which move from the outer sides of the frames on radial guides towards the center of the frame. The guides consist of slide rails which extend in spoke-like manner between an outer frame and an inner frame of the tentering frame. At the moment when the jaw opening of a tentering clamp detects the skin, a spring-loaded lock is released which firmly grips the skin. The tentering process itself is effected after connecting the tentering clamps to the skin in the manner that the tentering clamps are moved with a predetermined pulling force on their guides in the direction towards the outer frames. For this purpose the tentering frame is arranged on a machine table in which corresponding spoke-shaped slide rails are present, on which, slides driven by pull cords are displaceable, the slides being adapted for engagement to and disengagement from the corresponding tentering clamps. After the tentering, the frame is removed from the machine table and fed to a drying oven.

This known tentering device has the disadvantage that a dependable grasping of the three-dimensionally non-uniform hide by the tentering clamps is not assured. There is the danger that the tentering clamp which first comes against the outer edge of the skin to be tentered will not grip it because of its lobated shape but will push it inwardly in front of it. Tentering clamps lying adjacent thereto are then also not able to detect the outer edge of the leather with release of the lock so that a subsequent tentering process is also not possible. The operator must then bring all tentering clamps back to the starting position, place the skin on again, and undertake a new attempt with the machine. One essential cause of the unreliable operation of the tentering device described is the fact that the skin to be tentered is not held in its position on the tentering frame but can be displaced by the tentering clamps.

In order to achieve an improvement in this, it has already been proposed to arrange in lowerable manner above the tentering frame an alignment device of the nature of a backup device which has spoke-like ledges which correspond to the slide rails of the tentering frame and in this way, in the lowered condition of the aligning device, hold the skin fast between them. The required structural and manufacturing expense in this connection is disadvantageous, without the desired success being obtained, particularly in the case of thin skins. Folds or corrugations which are present in the hide are namely not smoothed out by the lowering pressing device but are pressed together in the position in which they are, with the result that in the outer region a dependable detection by the tentering clamps is not assured.

The invention therefore, in view of this prior art, is directed at creating a tentering device for the clamping of skins in tanning plants which makes possible a dependable detecting and holding fast of the outer edge of the skin to be tentered by the tentering clamps without slippage or displacement of the skin, while smoothing out folds and bulges.

This object is achieved in accordance with the invention in the manner that each tentering clamp bears, associated with it, a pressing device which is displaceable with it for holding the skin to be tentered fast in the position in which it lies on the tentering frame. The pressing device can be fastened either to the tentering clamp itself (FIGS. 3–4) or to the element, particularly a slide (e.g., members 15, 19 FIGS. 1–2), of the machine table which displaces the tentering clamp. It will accordingly travel together with the tentering clamp, and grasp and hold the outer vicinity of the skin in non-shiftable manner in its applied position, so that the lock jaw of the tentering clamp is released.

The pressing device is preferably turnable and has a rolling surface. It may in particular be a roller, cylinder or rotating brush, in which connection an area application of the roller or brush rather than a punctiform application of a roller is preferred for the tentering of thin skins because of the better smoothening action.

The advantage of the smoothing out of folds an undulations in the skin to be tentered is improved if—in accordance with one suitable embodiment of the invention—the pressing device carries out a relative movement which produces a pulling force on the skin. For this there may be provided, in particular, a separate drive for the turning motion of the roller, cylinder or rotating brush. The drive can be a belt drive which is moved from the element of the machine table which displaces the tentering clamp, with a step up ratio to the pressing device.

A further improvement in the result of the holding and in the desired smoothing of the skin to be held is obtained if the pressing device is arranged forward of the position of the clamp plane in the direction of advance of the tentering clamp. In this connection a plurality of rollers, cylinders or brushes can preferably be provided one in front of the other, possibly driven separately. A maximum spreading effect is obtainable thereby.

In general the pressing device—as the name itself indicates—requires a holder (e.g. roller 25, 30) which is arranged above the skin to be tensioned and a backer-up (center-holder) arranged below the skin. Depending on the position of the holder with respect to the tentering clamp, the backer-up is already present as part of the tentering frame or must be provided. If, for instance, the roller is in line with the tentering clamp in front of it, the backer-up can be the lower arm (11) of the opening of the tentering clamp or else its guide (4). If the holder of the pressing device is located alongside the tentering clamp, metal plates (6) arranged between the guides of the tentering frame can be provided as the backer-up. Preferably, in accordance with one suitable embodiment of the invention, as a backer-up a pressure roller, cylinder or brush is coordinated to the holder of the pressing device in a position below the skin to be tensioned. The roller, cylinder or brush and/or backer-up can be displaceable and spring-mounted for adaptation to the thickness of the skin.

In the preferred concrete structural embodiment of the invention, a substantially U-shaped lever flipped over forwardly by 90° and having widened arms is pivoted to the carriage (15, 19) of the machine table of each tentering clamp, said lever bearing the pressing device, particularly a roller, cylinder or brush, in rotatable fashion on its upper arm while it is acted on by a counterweight on its lower arm. In this embodiment of the invention while a pressing device is associated with each tentering clamp, the device, however, remains at the machine table when the tentering frame is fed to the drying oven. This is not true in the embodiments of the invention in which a roller as the pressing device is fastened on the tentering clamp itself, for instance via a lateral spacer. This embodiment can have advantages in the case of smaller plants, for instance plants for the treatment of half-skins.

In order that it have a high weight of its own, the pressing device may be made of steel and be covered with a plastic.

As a whole, the result is obtained by the invention that the skin to be tentered is dependably inserted into the tentering clamp, detected there, by a sensing lever and held fast by the lock jaw of the tentering clamp since any slippage of the skin is avoided by the pressing device, which smooths out folds and undulations. Even protruding tongues of the leather are pulled out and not—as previously—pushed back, folded on themselves, by the tentering clamp so that these disadvantages of the prior art are also eliminated. When an additional pulling force is used, a particular spreading effect is assured and it is no longer necessary to apply the skin to be tentered very smoothly onto the frame. Large savings in work as well as a smooth course of the operation with rapid set-up times are obtained.

Further details, features and advantages of the subject matter of the invention will become evident from the following description of the accompanying drawing in which various preferred embodiments of the invention are diagrammatically shown. In the drawing.

Figure 1:
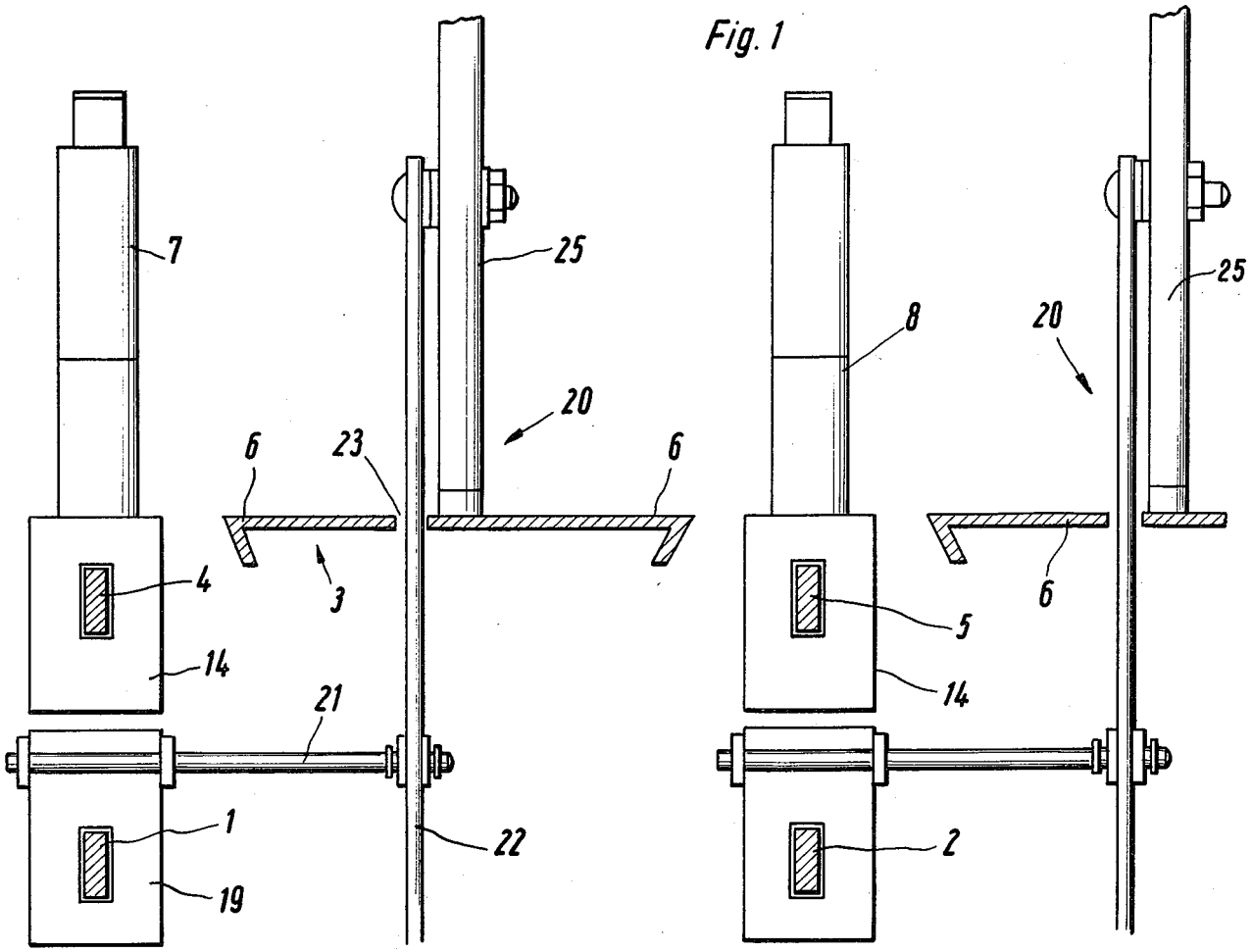
FIG. 1 shows the essential parts of a tentering device, in a rear view.

In the drawing only the technical parts of tentering devices which are directly related to the invention have been shown. In particular no attempt has been made to show the exact development of the known machine table on which tentering frames are placed, removed and fed to a drying oven and placed on again. With reference to the machine table there can be noted in FIG. 1 of the drawing only two guide rails 1 and 2 which consist of a rectangular steel section and belong to a plurality of guides which are arranged substantially in spoke-like manner in the machine table. On the machine table there rests a tentering frame 3 which comprises an outer frame (not shown), an inner frame, and a plurality of substantially radially extending guides 4, 5. The guides 4, 5 are of the same formation as the guide rails 1, 2 and are functionally associated with them, for which reason they are positioned in the same plane above the guide rails 1, 2.

In one clamping station about sixty such tentering frames 3 are required in order to tenter the hide or skin to be worked for the production of leather and then dry it on the tentering frame in an oven.

Between every two guides 4,5 a flat support 6 of sheet metal is arranged slightly below the work plane. Between two supports sufficient distance is left in the region of the guides 4, 5 in order to permit sufficient operating space for tentering clamps 7, 8 arranged displaceably on the guides 4, 5. As a whole, one tentering frame 3 in the embodiment described has 94 tentering clamps 7,8.

Figure 2:
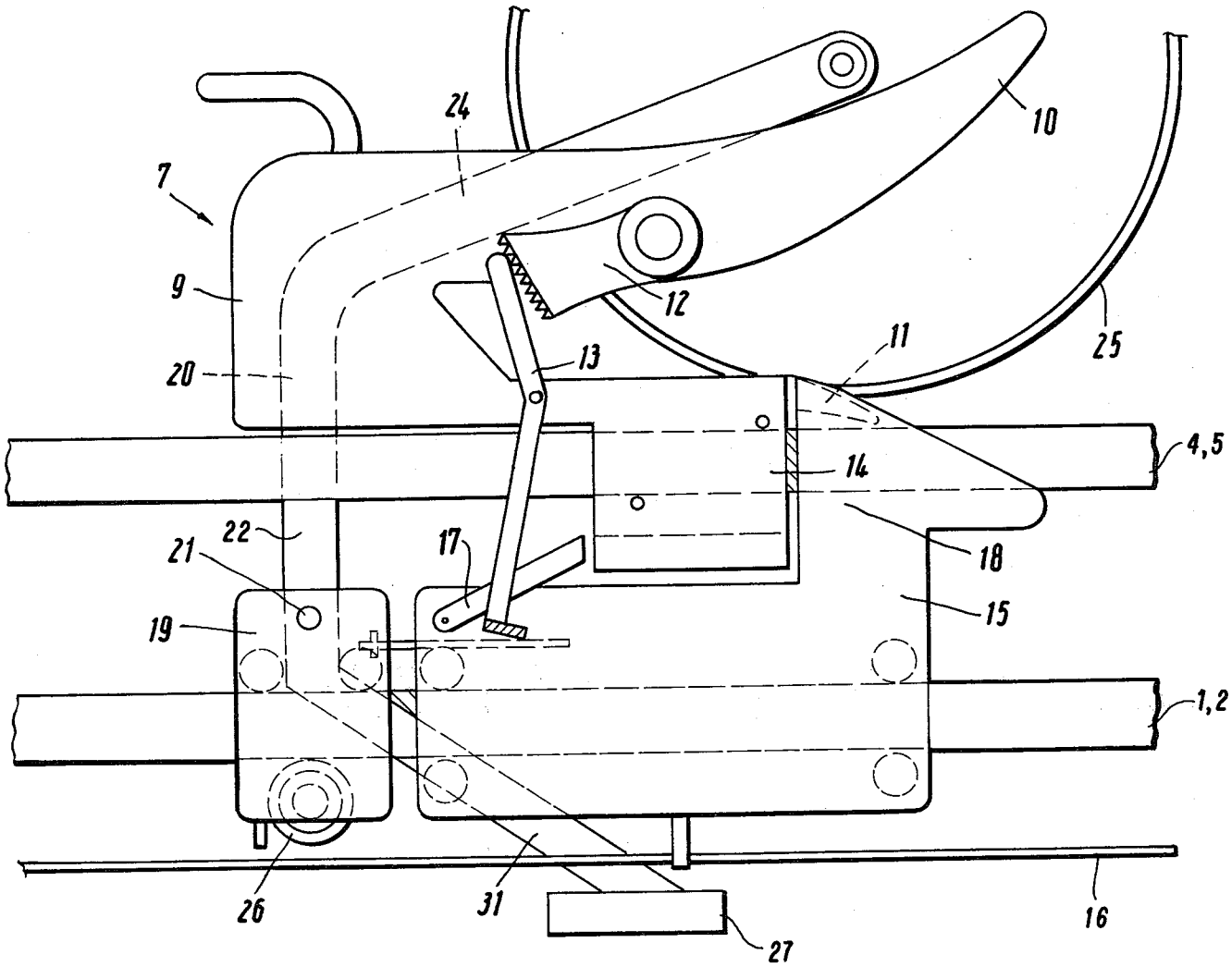
FIG. 2 shows the tentering device of FIG. 1 in a side view.

The tentering clamp 7,8 which can be noted in greater detail from FIG. 2 of the drawing, is made essentially of a plastic U-shaped section 9 turned over by 90° (i.e. sideways) the upper arm 10 and lower arm 11 of which widen towards the inside of the frame so as to form a jaw opening for the insertion of the outer edge of a skin which is to be tentered. The upper arm 10 bears a spring-biased lock jaw 12 having teeth which cooperates with the lower arm 11 for clamping fast of a therebetween, the lock jaw 12 being swung downward by the spring biasing force. The release of the lock jaw 12 actuating its downwardly swinging locking movement is effected by the skin by means of a sensing lever 13 which is pivotally mounted with spring biasing in the lower arm 11 and acts on a magnetic switch which controls an air valve which releases the locking of the lock jaw 12 from the upper position shown in the drawing.

On the lower arm 11 of the U-section 9 there is furthermore fastened a slide 14 which is displaceably mounted on the corresponding guide 4, 5.

The slide 14 is displaced by a carriage 15 traveling below it on the guide rails 1, 2, the carriage 15 being connected to a pull cord 16 which can be pulled back and forth by a compressed air cylinder. On the rear of the carriage 15 there is swingably supported a locking pawl 17 which carries along the slide in a foward direction, and at the front of the carriage 15 there is developed an upward-extending projection 18 which carries the tentering clamp 7,8 along with it in the rearward direction.

Behind the carriage 15, a carrier 19 for a pressing device 20, which carrier 19 is engageable with and disengageable from the carriage, respectively, is held in displaceable manner on the guide rails 1, 2. On the carrier 19 there is fastened, protruding laterally, a shaft 21 (also cf FIG. 5) which at its outer end carries in swingable manner a substantially U-shaped lever 22 which is positioned forwardly by 90°, i.e., as a sidewise forwardly facing U member. The lever 22 extends through the slot 23 in the support plate 6 and is provided on its upper arm 24 with a roller 25 of the pressing device 20 which is adapted to exert pressing and pulling forces on a skin which lies in the space between the roller surface and the lower arm 11 or the supporting plate 6.

Figure 5:
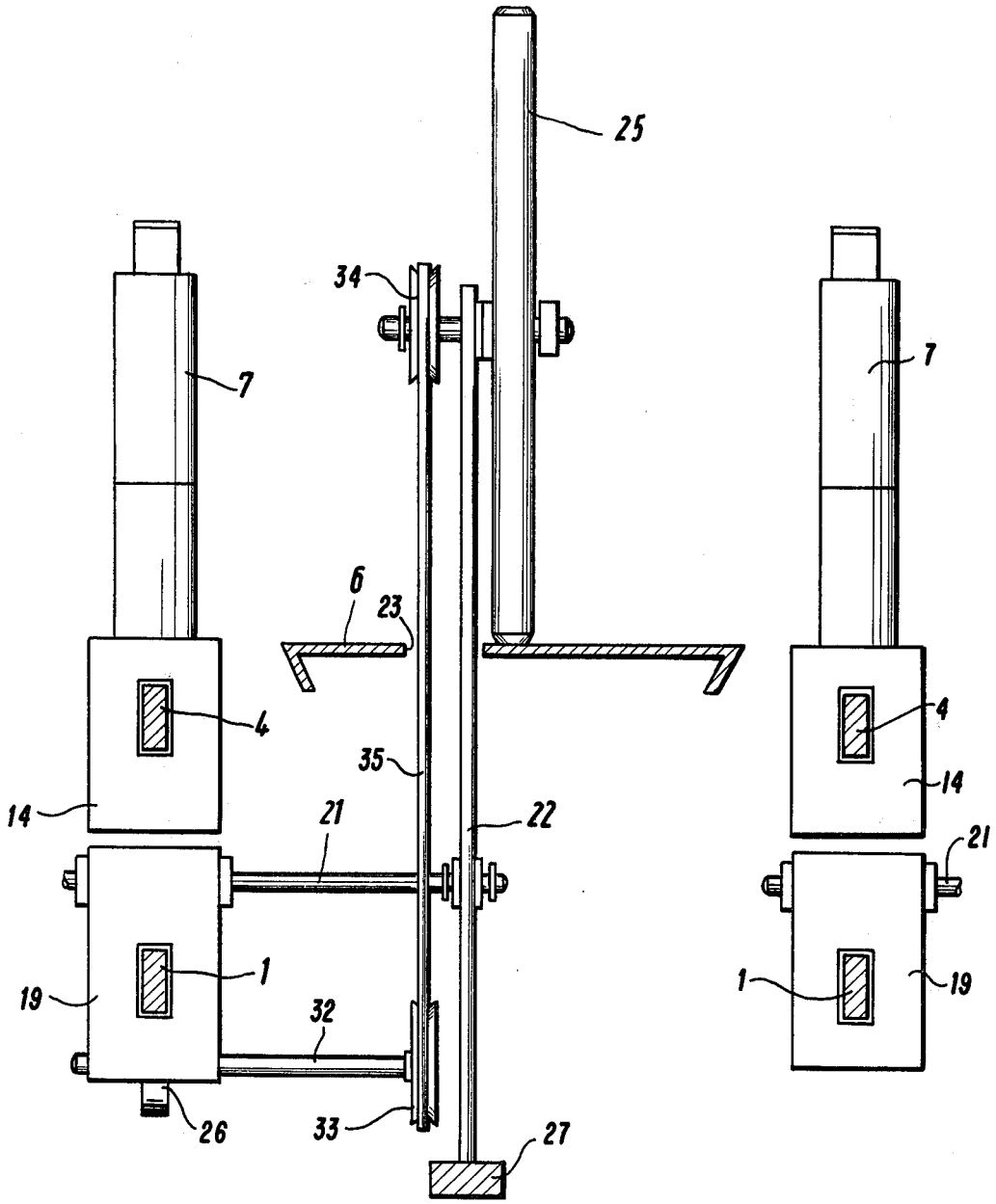
FIG. 5 is a rear view of a tentering device with a driven roller.

Such a pressing device 20 is associated, in the embodiment described, with each tentering clamp 7, 8 of the tentering frame 3. However, other embodiments are feasible in which, for instance, only every second tentering clamp has a pressing device associated with it, for instance if rollers 25 are arranged on both sides of a tentering clamp. One essential element of the arrangement of the roller 25 is its course with respect to the plane of the lock jaw 12, which can be noted from FIG. 2 of the drawing. It is also indicated there that the carrier 19 can be provided with a roller 26 which rolls on the guide rail 1 and the rotation of which can be utilized via a transmission, e.g. FIG. 5, to drive the roller 25 in such a manner that it exerts a pulling force on the skin located below it. In this case the roller 25 moves more rapidly than the tentering clamp 7, 8 due to the built-in step-up transmission. FIG. 5 shows a drive means comprising the driven roller 26 mounted on the carrier 19, and the transmission. The transmission comprises a shaft 32 jointly rotatably connected to the driven roller 26 and to a pulley 33. A pulley 34 is jointly rotatably connected to the roller 25. The roller 25 is turned by the pulley 34 via a transmission belt 35, mounted on the pulleys 33 and 34, driven by the shaft 32 and the pulley 33.

The lower arm 31 of the lever 22 bears a counterweight 27 the adjustment of which determines the amount of pressure force applied by the roller 25 against the skin. A swinging of the entire pressing device 20 around the pivot pin 21 is possible.

Figure 3:
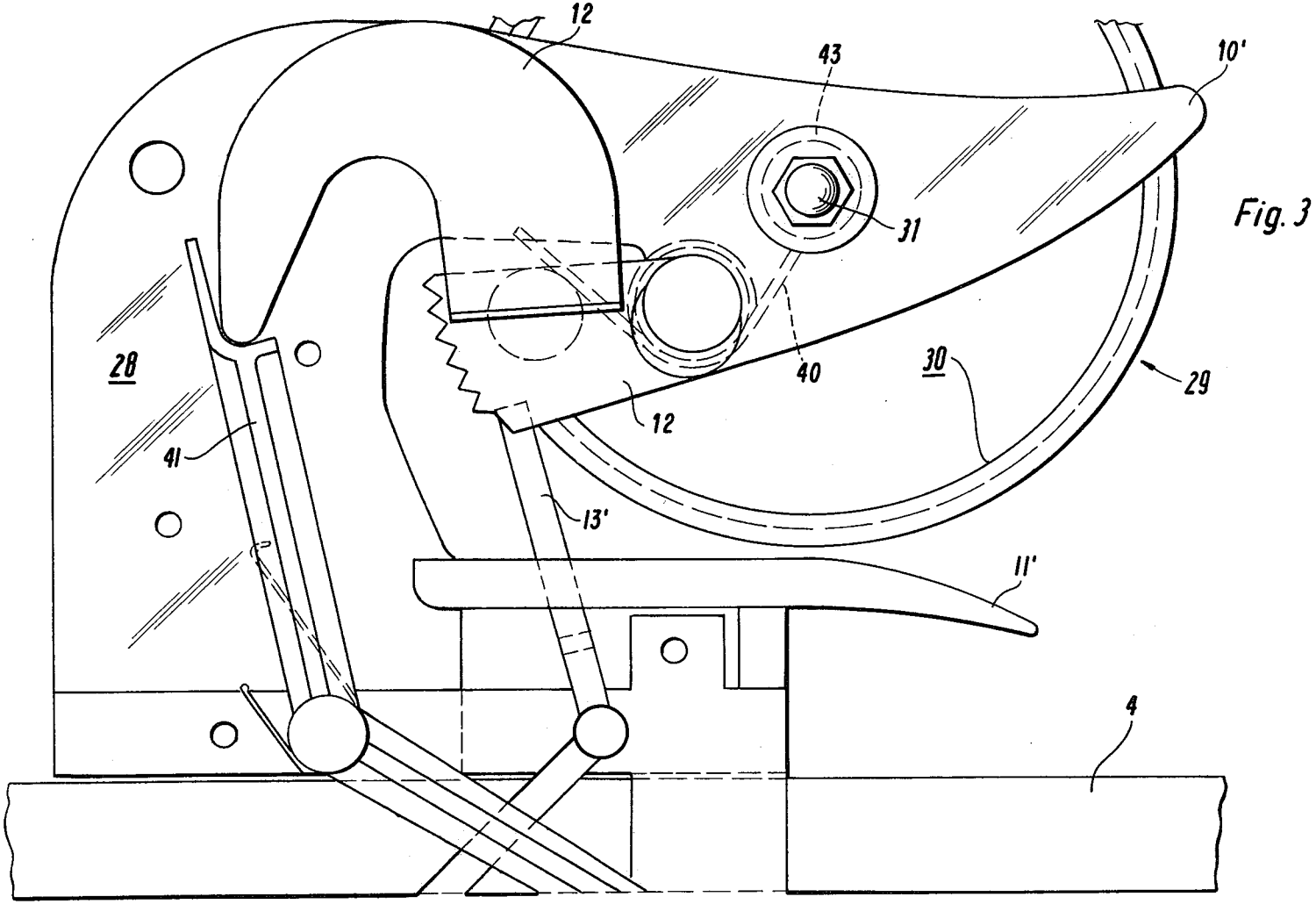
FIG. 3 is a side view of another embodiment of a tentering device.
Figure 4:
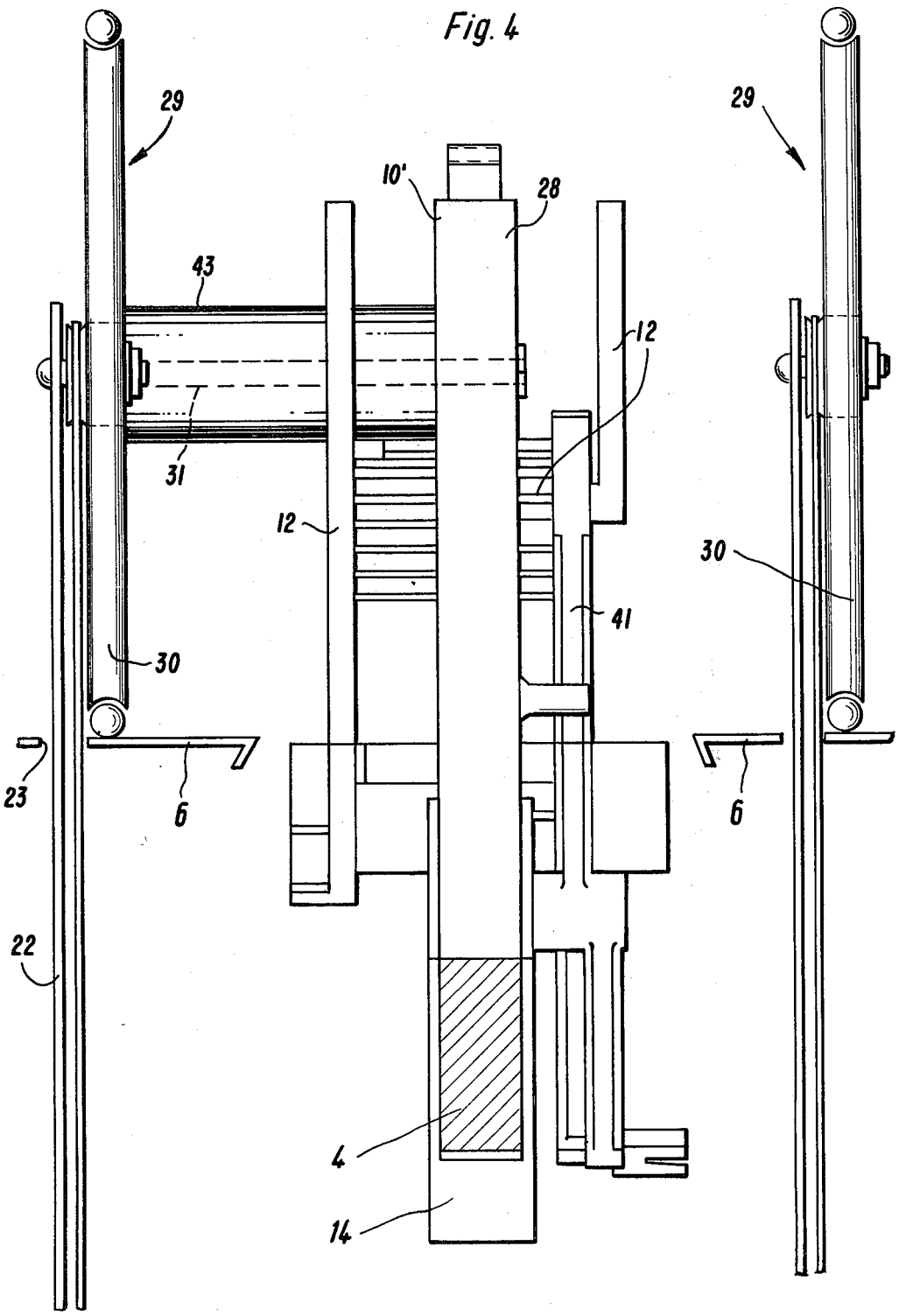
FIG. 4 is a rear view of the embodiment of FIG. 3.

FIGS. 3 and 4 of the drawing show an embodiment of a tentering clamp 28 which is itself equipped with a pressing device 29, comprising a roller 30 mounted by means of a pin 31 directly to the upper arm 10' of the tentering clamp 28. The pressing device 29 is thus part of the tentering clamp 28.

FIG. 3 is a side view of FIG. 4. This view shows the pressing devices 29 and their rollers 25 at each side of the tentering clamp 7 and shows only the upper guide rail 4 not showing the lower parts for simplicity of illustration. The lock jaw 12 is spring-biased by a spring 40 and is pivotally mounted on the upper arm 10' of the tentering clamp 28 as in the first embodiment. The lever 22 extends through the slot 23 in the support plate 6 as in the first embodiment and carries rotatably mounted thereon at its top the roller 25 which is adapted to exert pressing and pulling forces on a skin which lies in the space between the roller surface and the lower arm 11' when the spring-biased lock jaw 12 is pivoted by the spring 40 counter-clockwise so that its teeth point down and clamp the skin when sensing blocking lever 41 is moved out of the position of FIG. 3 where it is shown blocking the lock jaw 12.

A detailed description of the tentering clamp 28 with its various arcuate and angular levers for the clamping, release and reclamping of the lock jaw 12 is omitted since the development of the tentering clamp 28 is independent of the technical construction and function of the pressing device 29. The latter comprises the pressure roller 30 which is mounted for rotation on the pin 31, with a lateral spacer 43, on the upper arm 10' of the tentering clamp 28. The lead with respect to the clamping plane (the teeth of lock jaw 12 when it is pivoted down) can be noted from the drawing.

The action of the pressing devices 20 and 29 is that before the outer edge of the skin to be tentered reaches the lock jaw 12 pressing and possibly pull to the outside is exerted on the skin on both sides of each tentering clamp, and the skin is thereby smoothed and held flat against displacement so that the skin which is then inserted into the jaw opening of the tentering clamp, even at protruding tabs releases the sensing lever 13, 13' and thus brings the lock jaw 12 into clamping position without the possibility of the tentering clamp pushing the skin inwards in front of itself on the tentering frame without clamping.

What is claimed is:

1. In a device for tentering skins or hides for the manufacture of leather, having a tentering frame arranged on a machine table, in which frame a plurality of tentering clamps are held displaceably on substantially radial guides, the improvement comprising pressing means operatively coordinated adjacent to each said tentering clamp and such that said pressing means is displaceably mounted with said tentering clamp, said pressing means for holding a skin to be tensioned fast in position in which it has been placed on the tentering frame.

2. The tentering device according to claim 1, wherein said pressing means is detachably fastened to said tentering clamp.

3. The tentering device according to claim 1, wherein said pressing means is rotatable and has a rolling surface.

4. The tentering device according to claim 3, wherein said pressing means is a roller.

5. The tentering device according to claim 3, further comprising a separate drive means for rotating said pressing means.

6. The tentering device according to claim 5, further comprising means for displacing said tentering clamp, said means is an element of the machine table, said drive means is a belt drive which operatively extends from said element to said pressing means with a step-up transmission ratio.

7. The tentering device according to claim 3, wherein said pressing means are mounted displaceably and spring-biased for adaptation to the thickness of the skin.

8. The tentering device according to claim 3, wherein said pressing means is a cylinder.

9. The tentering device according to claim 3, wherein said pressing means is a rotating brush.

10. The tentering device according to claim 1, wherein said pressing means is for performing a relative movement on said skin applying tensile forces to the skin.

11. The tentering device according to claim 1, wherein said tentering clamp defines a clamping plane, said pressing means constitutes at least one pressing device arranged ahead of said clamping plane in a direction of advance of said tentering clamp.

12. The tentering device according to claim 11, wherein said pressing means include a plurality of rotatable members arranged one in front of the other and/or on both sides of said tentering clamp.

13. The tentering device according to claim 1, wherein said pressing means comprises a holder and a backer-up coordinating to each other, said backer-up is disposed in a position below the skin to be tensioned by said holder.

14. The tentering device according to claim 12, wherein said backer-up constitutes a rotatable member.

15. The tentering device according to claim 12, wherein said backer-up is mounted displaceably and spring-biased.

16. The tentering device according to claim 1, further comprising means for displacing said tentering clamp, said displacing means is a carriage of the machine table movably mounted on said radial guides, said pressing means is a rotatable member, a substantially U-shaped lever pivoted 90 degrees has widening arms constituting an upper arm and a lower arm, said U-shaped lever is pivoted to said carriage of the machine table of each said tentering clamp, said pressing means is rotatably connected to said upper arm of said U-shaped lever, and a counterweight is connected to said lower arm of said U-shaped lever.

17. The tentering device according to claim 1, further comprising a lateral spacer connected to each said tentering clamp, said pressing means comprises rotatable members on said lateral spacers, respectively.

18. The tentering device according to claim 1, wherein said pressing means is made of steel and is covered with plastic.

19. The tentering device according to claim 1, further comprising means for displacing said tentering clamp, said pressing means is detachably fastened to said displacing means.

20. The tentering device according to claim 19, wherein said displacing means is a carriage of the machine table.

21. The tentering device according to claim 1, further comprising sensing release means adjacent each said clamp for being actuated by an edge of the skin for actuating the clamp so as to clamp said skin, said pressing means for straightening out an incoming edge of the skin as the skin approaches said release means for causing said edge to dependably actuate said release means.

22. The tentering device according to claim 1, further comprising a drive means for rotating said pressing means so that the latter has a same direction of movement on said skin as the direction of displacement of said tentering clamps on said guides.

23. The tentering device according to claim 22, wherein said drive means comprises, a carrier movably mounted on one of said radial guides connected for joint displaceable movement with one of said tentering clamps and including a driven roller rollably engaging a bottom of said one radial guide, a transmission comprising a shaft jointly connected to said driven roller and a pair of pulleys being connected by a belt, said shaft is jointly connected to one of said pulleys and the other of said pulleys is connected to said pressing means.

* * * * *